US006338165B1

(12) United States Patent
Biondich

(10) Patent No.: US 6,338,165 B1
(45) Date of Patent: Jan. 15, 2002

(54) VISIONED ENHANCED FACE GUARD FOR A SPORTS HELMET

(76) Inventor: Paul Timothy Biondich, 16 Four Seasons Place, Suite 203, Etobicoke, Ontario (CA), M9B 6E5

( * ) Notice: Subject to any disclaimer, the term of this patent is extended or adjusted under 35 U.S.C. 154(b) by 0 days.

(21) Appl. No.: 09/575,233

(22) Filed: May 22, 2000

(51) Int. Cl.[7] ..... A42B 1/08
(52) U.S. Cl. ..... 2/424; 2/9
(58) Field of Search ..... 2/424, 9, 425, 2/421, 410, 455, 173, 909

(56) References Cited

U.S. PATENT DOCUMENTS 455,007 A * 6/1891 Rooney ..... 2/9
4,692,947 A * 9/1987 Black et al. ..... 2/421
4,741,054 A * 5/1988 Mattes ..... 2/421
4,766,610 A * 8/1988 Mattes ..... 2/425 X
5,249,347 A * 10/1993 Martinitz ..... 2/9 X
5,806,088 A * 9/1998 Zide et al. ..... 2/9
5,893,174 A * 4/1999 Primeau ..... 2/424
5,911,308 A * 6/1999 Chafitz et al. ..... 2/9

* cited by examiner

*Primary Examiner*—Rodney M. Lindsey
(74) *Attorney, Agent, or Firm*—Eugene J. A. Gierczak

(57) ABSTRACT

A headgear assembly for enhanced vision comprising of a guard assembly having an inner surface and outer surface. The inner surface includes a vision enhancing substance while the outer surface includes a light absorbing substance. The guard assembly is mounted to a helmet.

15 Claims, 1 Drawing Sheet

VISIONED ENHANCED FACE GUARD FOR A SPORTS HELMET

FIELD OF THE INVENTION

This invention relates in general to a headgear assembly and more particularly to the guard assembly mounted to the headgear assembly, which allows for enhanced vision for the user.

BACKGROUND OF THE INVENTION

Various types of protective headgear assemblies are worn in different types of sports such as hockey, football, lacross, and baseball. The headgear assemblies can come in various shapes and forms and are often provided with a type of face guard. In general, these face guards can be a protective visor or cage. There are various disadvantages with the current available face guards as they often impair the vision of the user using the headgear assembly.

For example, due to the nature of most sports requiring protective headgear and that the headgear assemblies must fit snugly around the user's head, the user often will perspire profusely from the head often resulting in impaired vision. Furthermore if the headgear assembly includes a protective visor, the perspiration will often cause fogging of the visor therefore impairing the user's vision. Moreover impaired vision may result in the more injuries to the user since their vision is limited.

The user's vision may also be impaired when the headgear assembly includes a face guard that is a cage. Typically the cage is mounted to the helmet portion of the headgear assembly and is usually painted. Traditionally the same colour of paint is used on both the outer surface and the inner surface of the cage. The colours that have typically been used have either been black or white. A disadvantage of using the painted cage is that the user's vision is impaired when they look through the cage. Specifically, the user's the line of vision is distorted by the painted lines or wires of the cage that the user sees when looking through the cage. The distortion may result in loss of peripheral vision and could cause injury or the inability to participate in the sport at the user's optimum level.

Furthermore, most of the sports requiring these headgear assemblies are played in lighted arenas or during daylight. The lighting often causes glare on the face guards which results in the impaired vision of the user. To combat the glare, in the case of the cage, the paint colour used on both the inner and outer surfaces of the cage has been black. The black surface on the outside of the cage reduces the glare from the lighting. However, the black surface on the inside of the cage disrupts the user's vision which results in impaired vision.

Conversely, the use of white paint on the outside surface does not reduce the glare from the lighting, yet may be less disruptive to the user's vision if the surface the user is playing on is white as in the instance of hockey. If the user is playing on grass as in the case of lacross or football, the white inside surface of the cage will also disrupt the user's vision.

Prior art headgear assemblies have been devised to address the some of the aforenoted problems. For example, U.S. Pat. No. 6,010,217 issued on Jan. 4, 2000 to Houston et al. This patent relates to an optically corrected shield for unitary lens eyeglasses or safety helmets. The shield is characterized by an optical centerline and a mechanical centerline, which intersect each other at an angle. The lens is oriented on the head of the wearer by a frame or helmet that maintains the lens in a position such that the optical centerline is maintained substantially in parallel to the normal sight line of the wearer.

Joslin et al. is the owner of U.S. Pat. No. 5,647,066 which issued on Jul. 15, 1997. This patent relates to an adjustable safety helmet visor that extends for protection for the face by providing a simple one-piece adjustable add-on visor that will fit a multitude of helmet configurations. The visor is formed of a pre-cut deformable synthetic resin material that is removably secured to the helmet by continuous bands of interengageable hook and loop material along its edges.

Smith, Jr. is the owner of U.S. Pat. No. 5,966,744 which issued on Oct. 19, 1999. This patent relates to a helmet apparatus including a head-covering assembly which has a top portion and a side portion extending downward from the top portion. A guard support is connected to the side portion of the head-covering assembly, and a guard assembly is connected to the guard support.

Thus a guard assembly for a headgear assembly having the ability to absorb light or reduce the glare from lighting on the outside surface, while enhancing the user's vision by matching the inside surface of the guard assembly to the playing environment is desirable.

SUMMARY OF THE INVENTION

An object of one aspect of the present invention is to provide an improved guard assembly for a headgear assembly.

In accordance with one aspect of the present invention there is provided a headgear assembly for enhanced vision comprising of a guard assembly having an inner surface and outer surface. The inner surface may be covered with a vision enhancing substance, while the outer surface may be covered with a light absorbing substance. Preferably the guard assembly is mounted to a helmet.

Conveniently, the guard assembly may further comprise of a securing means, a support means and a mask member each having an inner surface with a vision enhancing substance applied to it and an outer surface with a light absorbing substance applied to it.

Preferably, the paint on the inner surface for enhanced vision matches the environment viewed by a user wearing the headgear assembly and the paint on the outer surface had light absorbing qualities.

In accordance with another aspect of the present invention there is provided a method of enhancing the vision of a user wearing a headgear assembly comprising of wearing a helmet with a guard assembly. The guard assembly may have an inner surface and outer surface with the inner surface having a vision enhancing substance and the outer surface having a light absorbing substance.

In accordance with a further aspect of the present invention there is provided the use of a headgear assembly comprising of a guard assembly having an inner surface with a vision enhancing substance and an outer surface having a light absorbing substance for use in hockey.

Advantages of the present invention are improved vision for the user as there is no fogging of the cage as seen with visors, the environment blends into the inner surface of the cage so that the user's vision is not disrupted, improved peripheral vision during use of the headgear assembly, reduction of glare and reflected light as outer surface of the guard assembly has light absorbing properties.

BRIEF DESCRIPTION OF THE DRAWINGS

A detailed description of the preferred embodiment(s) is(are) provided herein below by way of example only and with reference to the following drawings, in which.

Figure 2:
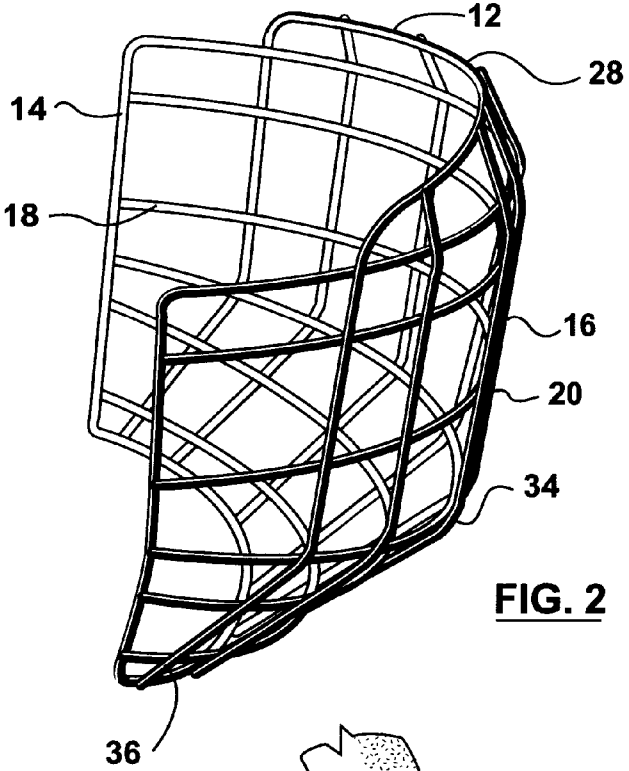
FIG. 2 in a perspective view, illustrates the headgear assembly of FIG. 1.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

Figure 3:
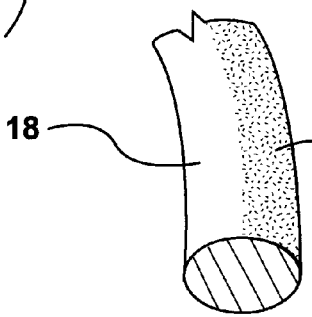
FIG. 3 in a close-up cut away view, illustrates both the inner surface having a vision enhancing substance and the outer surface having a light absorbing substance of FIG. 1.
Figure 1:
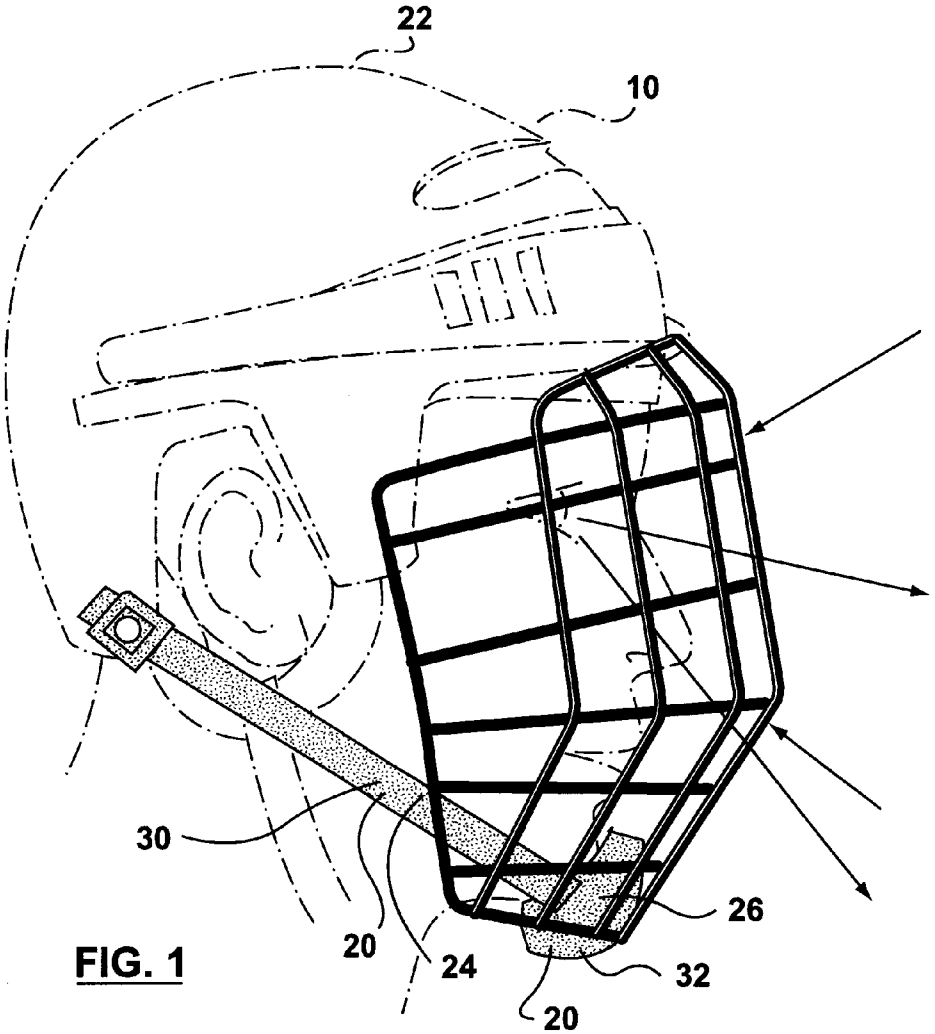
FIG. 1 in a side view, illustrates a headgear assembly for enhanced vision in operation in accordance with a preferred embodiment of the present invention.

Referring to FIGS. 1, 2 and 3 there is illustrated in a side, perspective and close-up views, a headgear assembly for enhancing vision 10 in accordance with the preferred embodiment of the present invention. The headgear assembly for enhancing vision 10 includes a guard assembly 12 having an inner surface 14 and outer surface 16. The inner surface 14 may have applied to it a vision enhancing substance 18. The outer surface 16 may have a light absorbing substance 20. The guard assembly 12 is mounted to a helmet 22.

The guard assembly 12 may be further defined as having a securing means 24, a support means 26 and a mask member 28. The securing means 24, the support means 26 and the mask member 28 may each have inner surfaces 14 with vision enhancing substance 18 and outer surfaces 16 with light absorbing substance 20. The securing means 26 may be further defined as an adjustable strap 30 that is mounted to the helmet 22. The support means 26 may be further defined as a chin guard 32 that is moveably attached to the adjustable strap 30 and protects the user's chin. The mask member 28 may be further defined as a cage 34 that is mounted to the helmet 22.

Both the vision enhancing substance 18 and the light absorbing substance 20 may be paint that is painted on to the inner and outer surfaces, 14 and 16 respectively, of the guard assembly 12. The paint for vision enhancement surface may match the environment viewed by a user when wearing the headgear assembly 10. For example where the user of the headgear assembly for enhancing vision 10 is playing a sport such as ice hockey, the vision enhancing substance 18 or paint would be white to match the colour of the surface the user is playing on, in this case ice. Similarly the vision enhancing substance 18 can be any colour that matches the environment or background the user is playing in. Therefore the vision enhancing substance 18 may be coloured different colours to match the different playing surfaces.

The purpose of the vision enhancing surface 18 on the inner surface 14 of the mask member 28 is to improve the vision of the user through the mask member 28. Currently the user's vision is disrupted by the mask member 28 or cage 34 since the wires or lines 36 from the cage 34 are in front of the user's eyes. More specifically the user's eyes have difficulty focusing through the wires or lines 36 as the wires 36 are traditionally a different colour than the environment that the user is looking at through the cage 34. The wires 36 are traditionally painted the same colour on both the inner and outer surfaces 14 and 16 respectively of the cage 34, and therefore do not take into account the different playing surfaces the user may be playing on.

By painting the vision enhancing surface 18 on the inner surface 14 of the cage 34 so that it matches the environment or background that the user is playing on, for example ice, the lines 36 of the cage 34 blend into the environment. Therefore the user's vision is improved and is not disrupted by the lines 36 of the cage 34 as the lines 36 blend into the environment that the user is in.

The outer surface 16 may have a light absorbing substance 20 that absorbs light so that the user does not experience light reflection or glare in the eyes. By reducing glare the user's vision is improved. The light absorbing substance 20 may be a paint that is painted on to the outer surface of the mask member 28. A dark coloured paint such as black would absorb the light and reduce glare.

In operation, the user would place the headgear assembly 10 on their head and adjust the adjustable strap 30 and chin guard 32 to the correct degree of tightness for the user's comfort. The user would see through the cage 34 having the vision enhancing substance 18 on the inner surface 14 of the cage 34 that matches the environment or playing surface that the user is playing in. The light absorbing substance 20 on the outer surface of the cage 34 will reduce the light reflection or glare the user experiences from the lighted environment.

In a another embodiment of the present invention there is provided a method of enhancing the vision of a user wearing a headgear assembly 10 comprising of wearing a helmet 22 with a guard assembly 12 having an inner surface 14 and outer surface 16. The method includes all previously disclosed attributes of the headgear assembly 10.

In a further embodiment of the present invention there is provided the use of the headgear assembly for enhancing vision 10 as described above for use in hockey and football.

Other variations and modifications of the invention are possible. All such modifications or variations are believed to be within the sphere and scope of the invention as defined by the claims appended hereto.

I claim:

1. A headgear assembly for enhanced vision comprising a guard assembly having an inner surface and an outer surface, said inner surface having a vision enhancing substance and said outer surface having a light absorbing substance mounted to a helmet, wherein said guard assembly further comprises a securing means, a support means and a mask member each having said inner surface with said vision enhancing substance and said outer surface with said light absorbing substance.

2. A headgear assembly for enhanced vision as claimed in claim 1 wherein said securing means is an adjustable strap.

3. A headgear assembly for enhanced vision as claimed in claim 1 wherein said support means is a chin guard.

4. A headgear assembly for enhanced vision as claimed in claim 1 wherein said mask member is a cage.

5. A headgear assembly for enhanced vision as claimed in claim 2 wherein said support means is a chin guard.

6. A headgear assembly for enhanced vision as claimed in claim 5 wherein said mask member is a cage.

7. A headgear assembly for enhanced vision as claimed in claim 1 wherein said vision enhancing substance is a paint for enhanced vision through said mask member applied to said inner surface of said mask member.

8. A headgear assembly for enhanced vision as claimed in claim 1 wherein said mask member is a cage with said paint applied to said inner surface.

9. A headgear assembly for enhanced vision as claimed in claim 8 wherein said head gear assembly is used in an environment and said paint for enhanced vision matches the environment viewed by a user wearing said headgear assembly.

10. A headgear assembly for enhanced vision as claimed in claim 9 wherein said paint is coloured white.

11. A headgear assembly for enhanced vision as claimed in claim 1 wherein said light absorbing substance is a paint for reducing glare applied to said outer surface of said guard assembly.

12. A headgear assembly for enhanced vision as claimed in claim 11 wherein said paint is coloured black.

13. A method of enhancing the vision of a user wearing a headgear assembly in an enviroment, defined by a mask member having an inner surface with a vision enhancing substance and an outer surface having a light absorbing substance further comprising painting said inner surface of said mask member with a paint that matches the environment viewed by said user wearing said headgear assembly.

14. A method of enhancing the vision of a user wearing a headgear assembly as claimed in claim 13 wherein said mask member is a cage having a painted inner surface for enhancing the vision of said user.

15. A method of enhancing the vision of a user wearing a headgear assembly as claimed in claim 14 further comprising painting said inner surface black.

* * * * *